US005507669A

United States Patent [19]

Jannett et al.

[11] Patent Number: 5,507,669

[45] Date of Patent: Apr. 16, 1996

[54] PIVOTING TAP BLADE FUSE

[76] Inventors: Robert E. Jannett; Richard Menta; Joseph Dominguez, all of 17 N. 22nd St., Kenilworth, N.J. 07033

[21] Appl. No.: 376,926

[22] Filed: Jan. 23, 1995

[51] Int. Cl.[6] ..... H01R 13/68

[52] U.S. Cl. ..... 439/621; 337/256; 439/509

[58] Field of Search ..... 439/620, 621, 439/622, 507, 509; 337/235, 255, 256

[56] References Cited

U.S. PATENT DOCUMENTS 4,913,663 4/1990 Siemon et al. ..... 439/509
4,944,697 7/1990 Doorman ..... 439/621
5,139,443 8/1992 Armando ..... 439/621
5,409,402 5/1994 Ball et al. ..... 439/621

*Primary Examiner*—David L. Pirlot

[57] ABSTRACT

A fuse for permitting a selective connection of a tap connector into a circuit. The inventive device includes a fuse body having blade terminals projecting therefrom and electrically coupled together by a first fuse link. A blade connector is pivotally mounted to the fuse body and received for storage within a longitudinal channel of the body. A second fuse link electrically couples the blade connector to one of the blade terminals, whereby the blade connector can be selectively pivoted from the fuse body to effect connection of an accessory tap connector into the associated circuit.

5 Claims, 3 Drawing Sheets

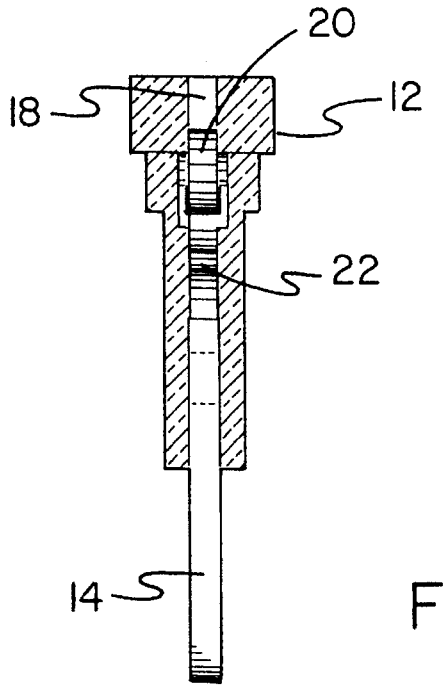
FIG. 4
FIG. 5
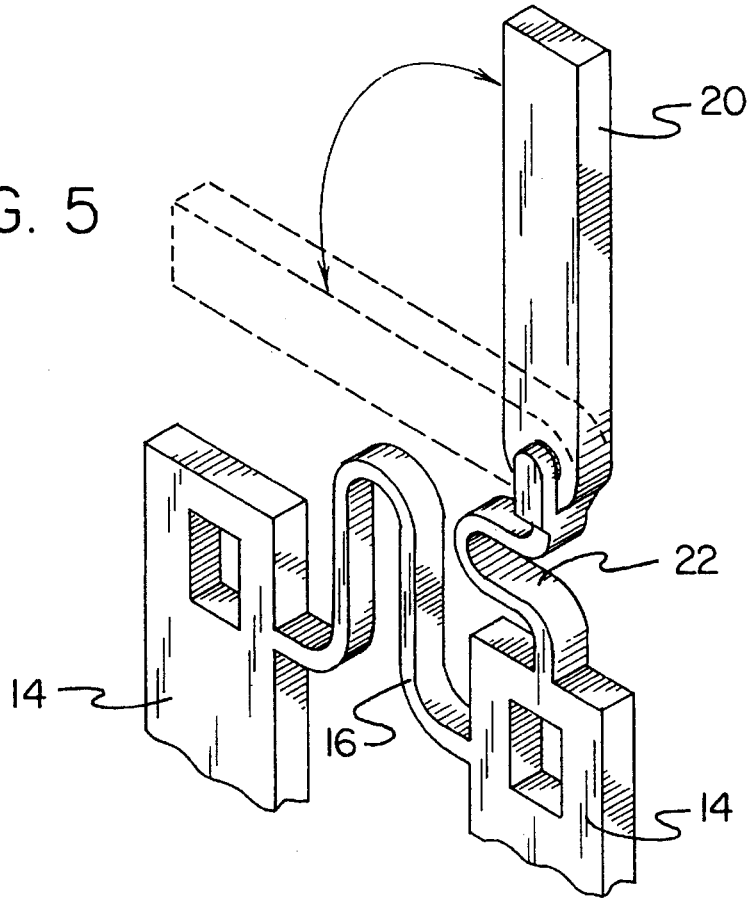

PIVOTING TAP BLADE FUSE

BACKGROUND OF THE INVENTION

1. Field of the Invention

The present invention relates to fuse devices and more particularly pertains to a pivoting tap blade fuse for permitting a selective connection of a tap connector into a circuit.

2. Description of the Prior Art

The use of fuse devices is known in the prior art. More specifically, fuse devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art fuse devices include U.S. Patent; U.S. Pat. No. 4,944,697; U.S. Pat. No. 4,884,050; U.S. Pat. No. 5,085,600; U.S. Pat. No. 4,722,701; U.S. Pat. No. 4,196,109; U.S. Pat. No. 5,154,640; U.S. Pat. No. 5,257,951; and U.S. Pat. No. 5,139,443.

While these devices fulfill their respective, particular objectives and requirements, the aforementioned patents do not disclose a pivoting tap blade fuse for permitting a selective connection of a tap connector into a circuit which includes a fuse body having blade terminals projecting therefrom and electrically coupled together by a first fuse link, a blade connector pivotally mounted to the fuse body, and a second fuse link electrically coupling the blade connector to one of the blade terminals, whereby the blade connector can be selectively pivoted from the fuse body to effect connection of an accessory tap connector into the associated circuit.

In these respects, the pivoting tap blade fuse according to the present invention substantially departs from the conventional concepts and designs of the prior art, and in so doing provides an apparatus primarily developed for the purpose of permitting a selective connection of a tap connector into a circuit.

SUMMARY OF THE INVENTION

In view of the foregoing disadvantages inherent in the known types of fuse devices now present in the prior art, the present invention provides a new pivoting tap blade fuse construction wherein the same can be utilized for permitting a selective connection of a tap connector into a circuit. As such, the general purpose of the present invention, which will be described subsequently in greater detail, is to provide a new pivoting tap blade fuse apparatus and method which has many of the advantages of the fuse devices mentioned heretofore and many novel features that result in a pivoting tap blade fuse which is not anticipated, rendered obvious, suggested, or even implied by any of the prior art fuse devices, either alone or in any combination thereof.

To attain this, the present invention generally comprises a fuse for permitting a selective connection of a tap connector into a circuit. The inventive device includes a fuse body having blade terminals projecting therefrom and electrically coupled together by a first fuse link. A blade connector is pivotally mounted to the fuse body and received for storage within a longitudinal channel of the body. A second fuse link electrically couples the blade connector to one of the blade terminals, whereby the blade connector can be selectively pivoted from the fuse body to effect connection of an accessory tap connector into the associated circuit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pivoting tap blade fuse apparatus and method which has many of the advantages of the fuse devices mentioned heretofore and many novel features that result in a pivoting tap blade fuse which is not anticipated, rendered obvious, suggested, or even implied by any of the prior art fuse devices, either alone or in any combination thereof.

It is another object of the present invention to provide a new pivoting tap blade fuse which may be easily and efficiently manufactured and marketed.

It is a further object of the present invention to provide a new pivoting tap blade fuse which is of a durable and reliable construction.

An even further object of the present invention is to provide a new pivoting tap blade fuse which is susceptible of a low cost of manufacture with regard to both materials and labor, and which accordingly is then susceptible of low prices of sale to the consuming public, thereby making such pivoting tap blade fuses economically available to the buying public.

Still yet another object of the present invention is to provide a new pivoting tap blade fuse which provides in the apparatuses and methods of the prior art some of the advantages thereof, while simultaneously overcoming some of the disadvantages normally associated therewith.

Still another object of the present invention is to provide a new pivoting tap blade fuse for permitting a selective connection of a tap connector into a circuit.

Yet another object of the present invention is to provide a new pivoting tap blade fuse which includes a fuse body having blade terminals projecting therefrom and electrically coupled together by a first fuse link, a blade connector pivotally mounted to the fuse body, and a second fuse link electrically coupling the blade connector to one of the blade terminals, whereby the blade connector can be selectively pivoted from the fuse body to effect connection of an accessory tap connector into the associated circuit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a cross sectional view taken along line 4—4 of FIG. 2.

FIG. 5 is an isometric illustration of the present invention having a fuse body and a cover plate thereof removed.

DESCRIPTION OF THE PREFERRED EMBODIMENT

Figure 1:
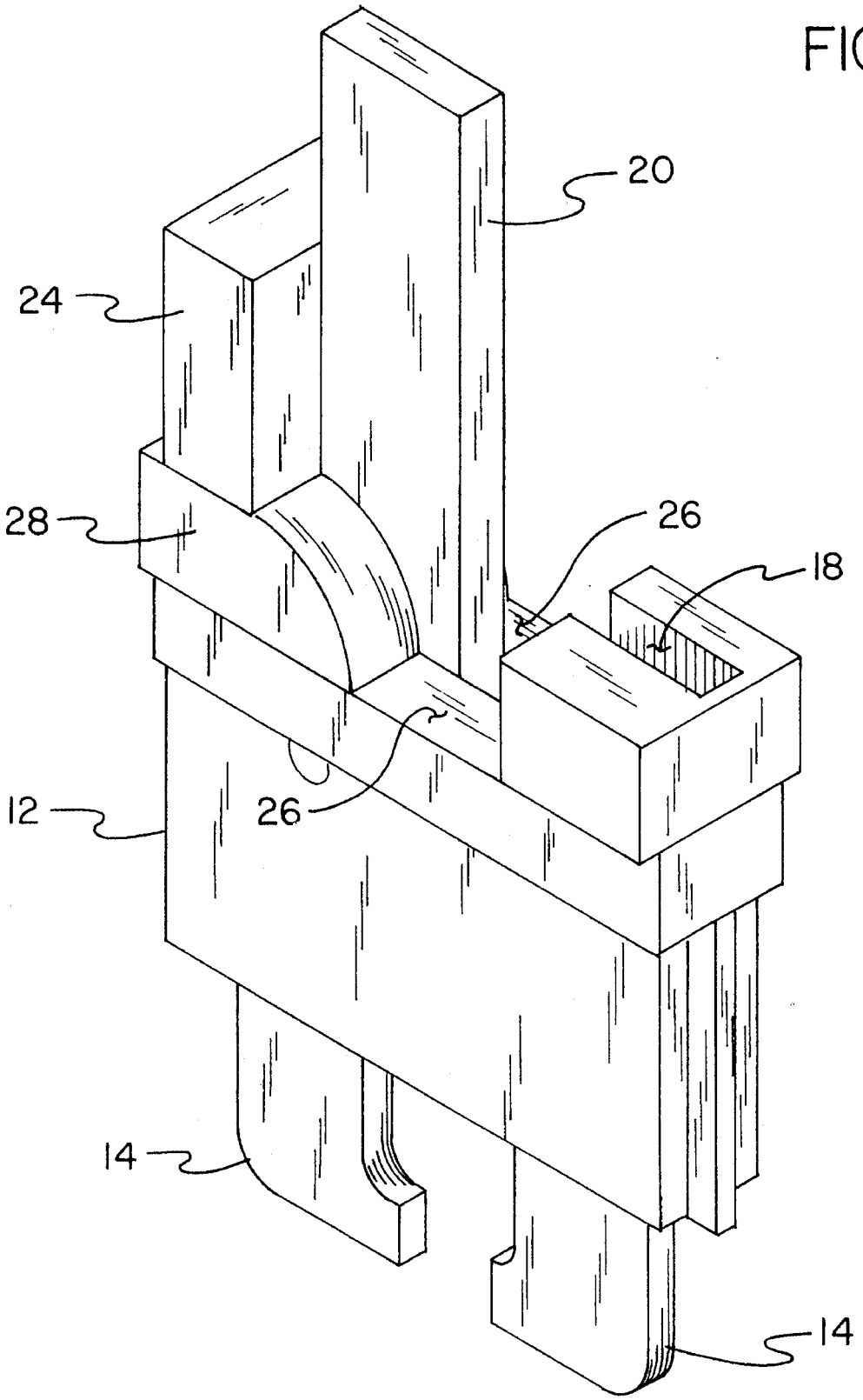
FIG. 1 is an isometric illustration of a pivoting tap blade fuse according to the present invention with a blade connector thereof in an extended position.

With reference now to the drawings, and in particular to FIGS. 1–5 thereof, a new pivoting tap blade fuse embodying the principles and concepts of the present invention and generally designated by the reference numeral 10 will be described.

Figure 2:
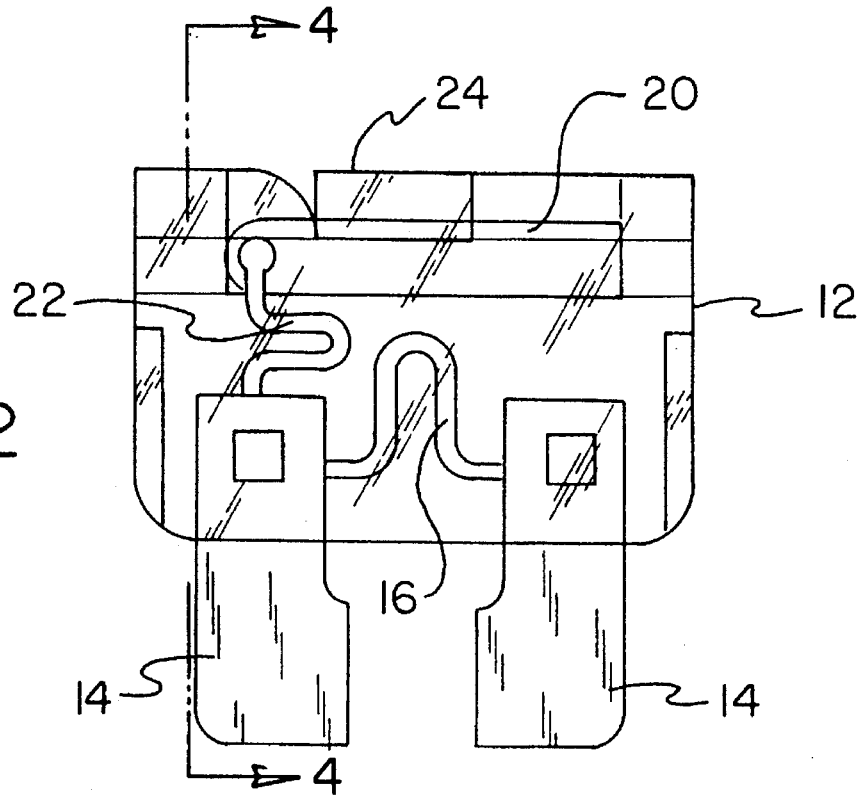
FIG. 2 is a front elevation view of the present invention with the blade connector in a stowed position.
Figure 3:
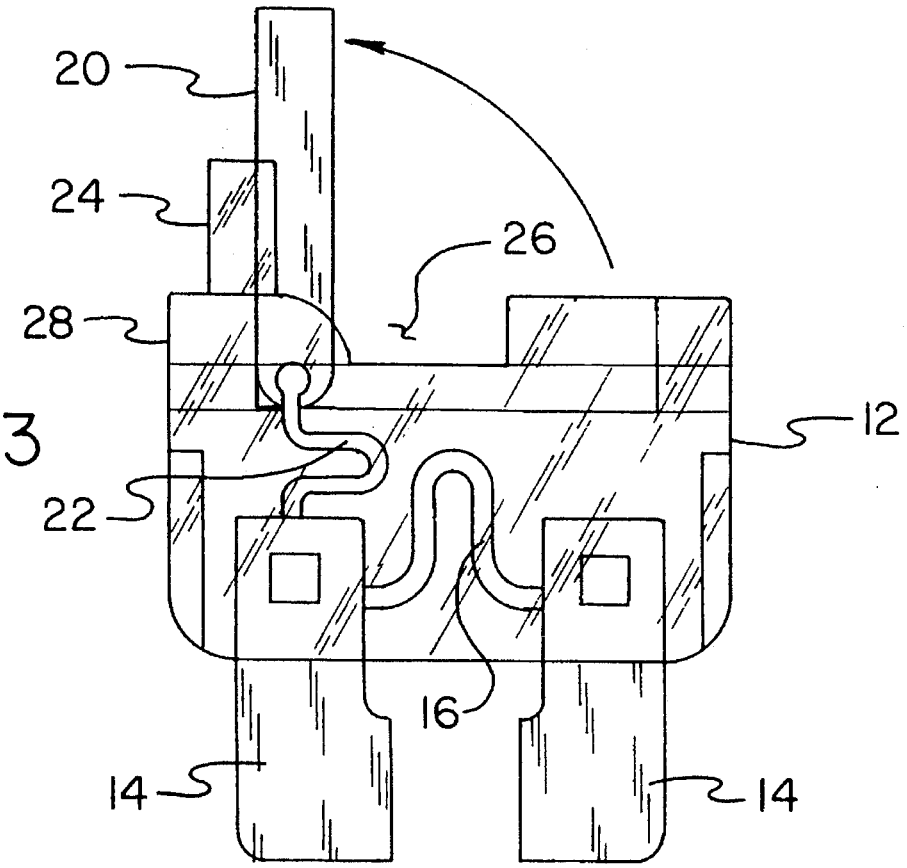
FIG. 3 is a front elevation view of the invention with the blade connector in the extended position.

More specifically, it will be noted that the pivoting tap blade fuse 10 comprises a substantially rectangular fuse body 12 mounting and supporting a pair of blade terminals 14 such that they project from the fuse body in a substantially spaced and parallel orientation, as shown in FIGS. 2 and 3 of the drawings. A first fuse link 16 extends between the blade terminals 14 within the fuse body 12 so as to electrically couple the blade terminals together. The first fuse link 16 is constructed of a material having a low melting point relative to the conductive material of the blade terminals 14 whereby the passage of a predetermined amount of current through the first fuse link will cause a melting thereof to result in a subsequent termination of electrical communication between the blade terminals. Thus, the fuse body 12 can be selectively inserted into an unillustrated fuse box of an automobile or the like and provide for current overload protection between the blade terminals 14.

As best illustrated in FIGS. 1 and 4, it can be shown that the fuse body 12 is shaped so as to define a longitudinal channel 18 extending across a top end thereof which receives a blade connector 20 therewithin. The blade connector 20 is pivotally mounted within the channel 18 of the fuse body 12 such that it can be pivoted from the stowed position illustrated in FIG. 2 into the extended position illustrated in FIGS. 1 and 3 of the drawings. The blade connector 20 is positioned into electrical communication with one of the blade terminals 14 by a second fuse link 22 extending between the blade connector and one of the blade terminals. Thus, the blade connector 20 is positioned into electrical communication with both of the blade terminals 14 when the first fuse link 16 is intact. However, should the first fuse link 16 become disconnected, the blade connector 20 will remain in electrical communication with one of the blade terminals 14 to provide current to an accessory connector attached thereto.

It is desirable for the second fuse link 22 to be configured to handle or tolerate a lower amperage or current than the first fuse link 16. By such configuration of the second fuse link 22, an overload current drawn through the blade connector 20 by an accessory tap connector will cause a blowing of the second fuse link 22, while the first fuse link 16 remains intact to continue providing electrical communication between the blade terminals 14.

To limit pivoting of the blade connector 20 relative to the fuse body 12 and to facilitate manual manipulation thereof in a pivoting of the blade connector from the channel 18, a cover plate 24 is secured to the blade connector and positioned for reception within a pair of opposed recesses 26 formed in the fuse body 12 along opposed sides of the longitudinal channel 18 thereof. The cover plate 24 engages a stop projection 28 of the fuse body 12 to limit pivoting of the blade connector 20 in the extended position.

As shown in FIG. 5, wherein the fuse body 12 is removed, the second fuse link 22 includes a yoke within which the blade connector 20 is pivotally mounted by a through-extending axle which frictionally and electrically engages the blade connector to promote retention of the blade connector 20 in a desired orientation and facilitate electrical communication between the blade connector and the second fuse link 22.

In use, the pivoting tap blade fuse 10 according to the present invention can be easily installed within a fuse block of an existing circuit. The blade connector 20 can then be selectively pivoted from the channel 18 of the fuse body 12, whereby a female spade type connector can be coupled to the blade connector 20 to introduce an accessory into the circuit. Should the unillustrated accessory draw an excessive amount of current, the second fuse link 22 will blow before the first fuse link 16, thereby providing for an uninterrupted continuation of electrical communication between the blade terminals 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A pivoting tap blade fuse comprising:

a fuse body;

a pair of blade terminals projecting from the fuse body in a substantially spaced and parallel orientation;

a first fuse link extending between the blade terminals within the fuse body so as to electrically couple the blade terminals together;

a blade connector pivotally mounted to the fuse body; and, a second fuse link extending between the blade connector and one of the blade terminals so as to position the blade connector into electrical communication with both of the blade terminals.

2. The pivoting tap blade fuse of claim 1, wherein the second fuse link is configured to handle a lower amperage or current than the first fuse link.

3. The pivoting tap blade fuse of claim 2, wherein the fuse body is shaped so as to define a longitudinal channel extending across a top end thereof; with the blade connector being pivotally mounted to the fuse body within the channel such that it can be pivoted from a stowed position into an extended position.

4. The pivoting tap blade fuse of claim 3, wherein a cover plate is secured to the blade connector and positioned for reception within a pair of opposed recesses formed in the fuse body along opposed sides of the longitudinal channel thereof.

5. The pivoting tap blade fuse of claim 4, wherein the second fuse link includes a yoke within which the blade connector is pivotally mounted, with an axle extending through the yoke and a portion of the blade connector to frictionally and electrically engage the blade connector to promote retention of the blade connector in a desired orientation and facilitate electrical communication between the blade connector and the second fuse link.

* * * * *